US007073567B2

(12) United States Patent
Berchowitz

(10) Patent No.: US 7,073,567 B2
(45) Date of Patent: Jul. 11, 2006

(54) CONDENSER EVAPORATOR AND COOLING DEVICE

(75) Inventor: David M. Berchowitz, Athens, OH (US)

(73) Assignee: Global Cooling BV, Helmond (NL)

( * ) Notice: Subject to any disclaimer, the term of this patent is extended or adjusted under 35 U.S.C. 154(b) by 307 days.

(21) Appl. No.: 10/474,403

(22) PCT Filed: Aug. 1, 2002

(86) PCT No.: PCT/US02/24191

§ 371 (c)(1),
(2), (4) Date: Oct. 8, 2003

(87) PCT Pub. No.: WO03/016795

PCT Pub. Date: Feb. 27, 2003

(65) Prior Publication Data

US 2004/0134638 A1 Jul. 15, 2004

(30) Foreign Application Priority Data

Aug. 14, 2001 (JP) ..... 2001-245958

(51) Int. Cl.
*F25B 29/00* (2006.01)

(52) U.S. Cl. ..... 165/48.1; 165/175

(58) Field of Classification Search ..... 165/48.1, 165/175, 125; 62/305, 506, 507
See application file for complete search history.

(56) References Cited

U.S. PATENT DOCUMENTS

| | | | | | |
|---|---|---|---|---|---|
| 2,823,522 | A * | 2/1958 | Collins | 165/171 |
| 2,863,645 | A * | 12/1958 | Spieth | 165/125 |
| 3,704,748 | A * | 12/1972 | Hapgood | 165/125 |
| 3,759,321 | A * | 9/1973 | Ares | 165/125 |
| 3,908,393 | A | 9/1975 | Eubank | |
| 4,932,467 | A | 6/1990 | Wigmore et al. | |
| 4,967,830 | A * | 11/1990 | Eubank et al. | 165/48.1 |
| 5,038,854 | A * | 8/1991 | Peterson, III | 62/507 |
| 5,257,660 | A | 11/1993 | Cargile | |
| 5,884,696 | A | 3/1999 | Loup | |
| 6,189,603 | B1 | 2/2001 | Sugimoto et al. | |
| 6,236,810 | B1 | 5/2001 | Kadotani | |
| 6,302,193 | B1 | 10/2001 | Inaba et al. | |
| 2002/0083733 | A1 * | 7/2002 | Zhang et al. | 62/509 |

* cited by examiner

*Primary Examiner*—Ljiljana Ciric
(74) *Attorney, Agent, or Firm*—Frank H. Foster; Kremblas, Foster, Phillips & Pollick

(57) ABSTRACT

The invention provides a compact and inexpensive cooling device with high heat transfer efficiency and with easy maintenance. The cooling device includes a condenser (10), an evaporator (20), and a pair of refrigerant flow passages between them. In each of the condenser (10) and the evaporator (20), through holes (11*a*, 21*a*) are formed in parallel with each other. The condenser (10) is formed in a cylindrical shape and installed around the cooling head of the refrigerator by a clamp (14). The evaporator (20) is installed the outside. The refrigerant is liquefied in the condenser (10) by releasing its heat, flows down into the evaporator (20) through the flow passage and is vaporized in the evaporator (20) by absorbing heat from the outside. The vaporized refrigerator flows up and returns into the condenser (10).

7 Claims, 6 Drawing Sheets

CONDENSER EVAPORATOR AND COOLING DEVICE

BACKGROUND OF THE INVENTION

The present invention relates to a cooling device, more particularly to a condenser that rejects heat of a refrigerant to the heat absorption portion of an exterior refrigerator and liquefies it, an evaporator that absorbs heat from an object to be cooled and vaporizes the refrigerant, and a cooling device including the condenser and the evaporator.

DESCRIPTION OF THE RELATED ART

Various types of cooling devices have been proposed to cool spaces or objects. In some applications, however, it may be difficult to install the heat absorption portion of the cooling devices in proximity to those spaces or objects. An icebox used in a car has a difficulty to directly attach the heat absorption portion thereon due to the limitation of available spaces interior of the car. Warming of the car interior by the heat radiation of the cooling device has to be avoided as well. In cooling the CPU of the computer where many associated parts are arranged in narrow spaces, installation of cooling devices near the CPU is further difficult.

In order to resolve such difficulties in installation of cooling devices, a cooling means, having the following configuration and shown in FIG. 10, has been proposed. An exterior refrigerator is spaced apart from an object 92 to be cooled, and a refrigerant are circulated between the heat absorption portion 91 of the exterior refrigerator and the object 92 to be cooled. That is, the refrigerant is cooled at a heat reject portion 51 attached to the heat absorption portion 91 of the exterior refrigerator, then being introduced through a passage 55 to a heat absorption portion 52 provided in contact with the object 92 to be cooled, thereby the object 92 is cooled. The refrigerant warmed at the heat absorption portion 52 is circulated back to the heat reject portion 51 through a passage 56.

In the above cooling means, the heat reject portion 51 is thermally coupled with the heat absorption portion 91 of the exterior refrigerator in such a configuration that a refrigerant pipe is wound around or laid along the heat absorption portion 91 of the exterior refrigerator. The heat absorption portion 52 is thermally coupled with the object 92 in the same configuration as well.

The above cooling means, by its nature, needs enhancing either the heat transfer performance between the heat absorption portion 91 of the exterior refrigerator and the heat reject portion 51 or that between the object 92 to be cooled and the heat absorption portion 52 in order to improve its cooling efficiency.

Further, size reduction of the cooling means is required as well. In the application of the cooling means to the computer CPU or the like, in which as the object 92 to be cooled is extremely small with only a small amount of heat generated, the exterior refrigerator is small, the heat reject portion 51 fixed to the heat absorption portion 91 thereof has to be small, and so does the heat absorption portion 52 fixed to the object 92. In summary, both the size reduction of either the heat reject portion 51 or the heat absorption portion 52 and the increases of their heat transfer performance are important.

The cooling means also requires simple and easy means for attaching the heat reject portion 51 to the heat absorption portion 91 of the exterior refrigerator or detaching it therefrom and that for attaching the heat absorption portion 52 to the object 92 to be cooled or detaching it therefrom without sacrificing its heat transfer performance.

Accordingly, an object of the present invention is to provide a compact condenser and evaporator with an efficient heat transfer performance and with easy maintenance and to provide a cooling device having including the compact condenser and evaporator.

SUMMARY OF THE INVENTION

In accordance with a first aspect of the present invention, a condenser that condenses a refrigerant gas by rejecting heat of the gas to a predetermined column-like shaped heat absorption portion of an exterior cooling device includes a condensing portion, an inlet portion, and an outlet portion. The condensing portion is formed of a flat plate shaped so as to surround the entire periphery of the column-like shaped heat absorption portion. The condensing portion further has a plurality of through holes formed along the circumferential direction thereof and arranged in parallel with each other. The inlet and outlet portions being hollow tubes have a closed end and an open end respectively. The inlet portion is connected to one end face of the condensing portion that is perpendicular to the circumferential direction of the condensing portion. The inlet portion communicates with all of the through holes. The outlet portion is connected to the other end face of the condensing portion that is perpendicular to the circumferential direction of the condensing portion. The outlet portion communicates with all of the through holes. The open end of the inlet portion is connected to an inflow passage of the refrigerant. The open end of the outlet portion is connected to an outflow passage of the refrigerant which section area is smaller than that of the inflow passage. The condensing portion is inserted into and fixed to the column-like shaped heat absorption portion.

The end faces of the condensing portion that are perpendicular to the circumference thereof not only means those formed by dividing the entire circumference thereof into two semicircles, but also means those formed by cutting the condensing portion at one portion on its circumference.

By employing the above-described configuration, the present invention provides the following functions and effects. Namely, if temperature of a refrigerant is merely lowered at a heat-rejecting portion, no more than the amount of heat is rejected which corresponds to the multiplier of the heat capacity of the refrigerant by the temperature differentials of the refrigerant. On the other hand, the present invention enables to reject a larger amount of heat by condensing a refrigerant vapor at a condensing portion, to achieve a highly effective heat transfer. Moreover, the condensing portion is configured so that the entire periphery of the column-like shaped heat absorption portion is surrounded with a flat plate having a number of narrow through holes arranged. Accordingly, while the heat transfer area can be larger, the heat absorption portion and the heat condensing portion attached thereto can be smaller.

Further, as the condensing portion is attached only by inserting it to the column-like shaped heat absorption portion, attachment and detachment can be easier, and assembling and maintenance workability is improved without impairing its heat transfer performance.

The section area of the outflow passage of the refrigerant is smaller than that of the inflow passage, because as the volume of the vaporized refrigerant drastically decreases by condensing, smaller section area is enough for the outflow passage.

In accordance with a second aspect of the present invention, the condenser in the first aspect thereof is further provided with a clamp formed so as to surround the condensing portion, inserted into the column-like shaped heat absorption portion, and attached to it by fastening the clamp.

With employing the above-described configuration, the present invention provides the following functions and effects. When the condensing portion is inserted into the column-like shaped heat absorption portion, if either the outer periphery of the heat absorbing portion or the inner circumference of the condensing portion is not precisely finished, they has to loosely contact with each other, causing poorer heat transfer performances. In the present invention, however, in which the outer circumference of the condensing portion is fastened to the heat absorption portion by means of a clamp, they closely contacts with each other, enabling easy attachment and detachment without reducing its heat transfer performance. Consequently, the invention improves workability of assembly, maintenance or inspection without impairing heat transfer performance.

In accordance with a third aspect of the present invention, the condensing portion either in the first or second aspect thereof is comprised of a plurality of hollow tubes that are arranged in parallel with each other.

In this configuration, nearly equal functions and effects as mentioned above can be achieved at a lower cost.

In accordance with a fourth aspect of the present invention, an evaporator that vaporizes a liquid refrigerant by absorbing heat from an exterior heat source includes a vaporizing portion, an inlet portion, and an outlet portion. The vaporizing portion is formed of a flat plate provided with a plurality of through holes arranged in parallel with each other. The inlet and outlet portions being hollow tubes have a closed end and an open end respectively. The inlet portion is connected to one end portion of the vaporizing portion at its outer circumferential surface. The inlet portion further communicates with all of the through holes. The outlet portion is connected to the other end portion of the vaporizing portion at its outer circumferential surface. The outlet portion further communicates with all of the through holes. The open end of the inlet portion is connected to an inflow passage of the refrigerant. The open end of the outlet portion is connected to an outflow passage of the refrigerant which section area is larger than that of the inflow passage. The vaporizing portion is attached to the exterior heat source.

The above-mentioned configuration of the present invention provides following effects. Generally, in raising the temperature of a cold liquid refrigerant at a cooling portion, no less than the amount of heat is absorbed which corresponds to the multiplier of the heat capacity of the liquid refrigerant by the temperature difference thereof. On the other hand, in the present invention, if the liquid refrigerant is vaporized at an evaporator, an amount of heat equivalent to the vaporization heat thereof may be absorbed, thereby higher heat transfer performance is achieved. Further, as the heat transfer area of the evaporator is enlarged by employing a flat plate with a number of through holes disposed therein in parallel with each other, the evaporator attached to the exterior heat source can be reduced in size. This configuration of the present invention is especially effective for highly integrated small objects such as the CPUs for computer.

Further, the evaporator can be easily attached to or detached from objects to be cooled by means of nuts or clamps, assembly, maintenance and inspection thereof can be improved without impairing its heat transfer performance.

Furthermore, in the evaporator of the present invention, the section area of the outflow passage of the refrigerant is larger than that of the inflow passage, as volume of the refrigerant increases greatly by the vaporization.

In accordance with a fifth aspect of the present invention, an evaporator that vaporizes a liquid refrigerant by absorbing heat from air passing through includes a vaporizing portion, an inlet portion, an outlet portion and a fin. The vaporizing portion is formed of a flat plate provided with a plurality of through holes arranged in parallel with each other. The vaporizing portion is bended to insert a space having predetermined height and length between it.

The fin is inserted into the space crossing with the through hole direction. The inlet and outlet portions being hollow tubes have a closed end and an open end respectively. The inlet portion is connected to one lower end portion of the vaporizing portion at its outer circumferential surface. The inlet portion further communicates with all of the through holes. The outlet portion is connected to the other higher end portion of the vaporizing portion at its outer circumferential surface. The outlet portion further communicates with all of the through holes. The open end of the inlet portion is connected to an inflow passage of the refrigerant. The open end of the outlet portion is connected to an outflow passage of the refrigerant which section area is larger than that of the inflow passage.

The above-mentioned configuration of the present invention provides following effects. The heat transfer area of the evaporator can be enlarged by employing a flat plate with a number of through holes. Further, the evaporator with long length can be small sized by bending it. And further more, the heat transfer area with hot air passing through can be increased by installing the fin between the bended vaporizing portion. Consequently, the evaporator can be small sized, while the heat transfer aria with the refrigerant and the hot air passing through can be increased.

In accordance with a sixth aspect of the present invention, the vaporizing portion either in the fourth or fifth aspect thereof is formed of a plurality of hollow tubes arranged in parallel with each other.

By employing above-mentioned configuration of the present invention, same effects as previously mentioned can be achieved at a lower cost.

In accordance with a seventh aspect of the present invention, there is provided a cooling device comprising the condenser either in the first, second, or third aspect thereof and the evaporator either in the fourth, fifth or sixth aspect thereof, wherein the outflow passage of the condenser is connected to the inflow passage of the evaporator, and the inflow passage of the condenser is connected to the outflow passage of the evaporator.

The above-mentioned configuration of the present invention can reduce the size of the device, enhance cooling efficiency, and improve workability of assembly, maintenance or inspection.

DETAILED DESCRIPTION OF THE PREFERRED EMBODIMENTS

Figure 1:
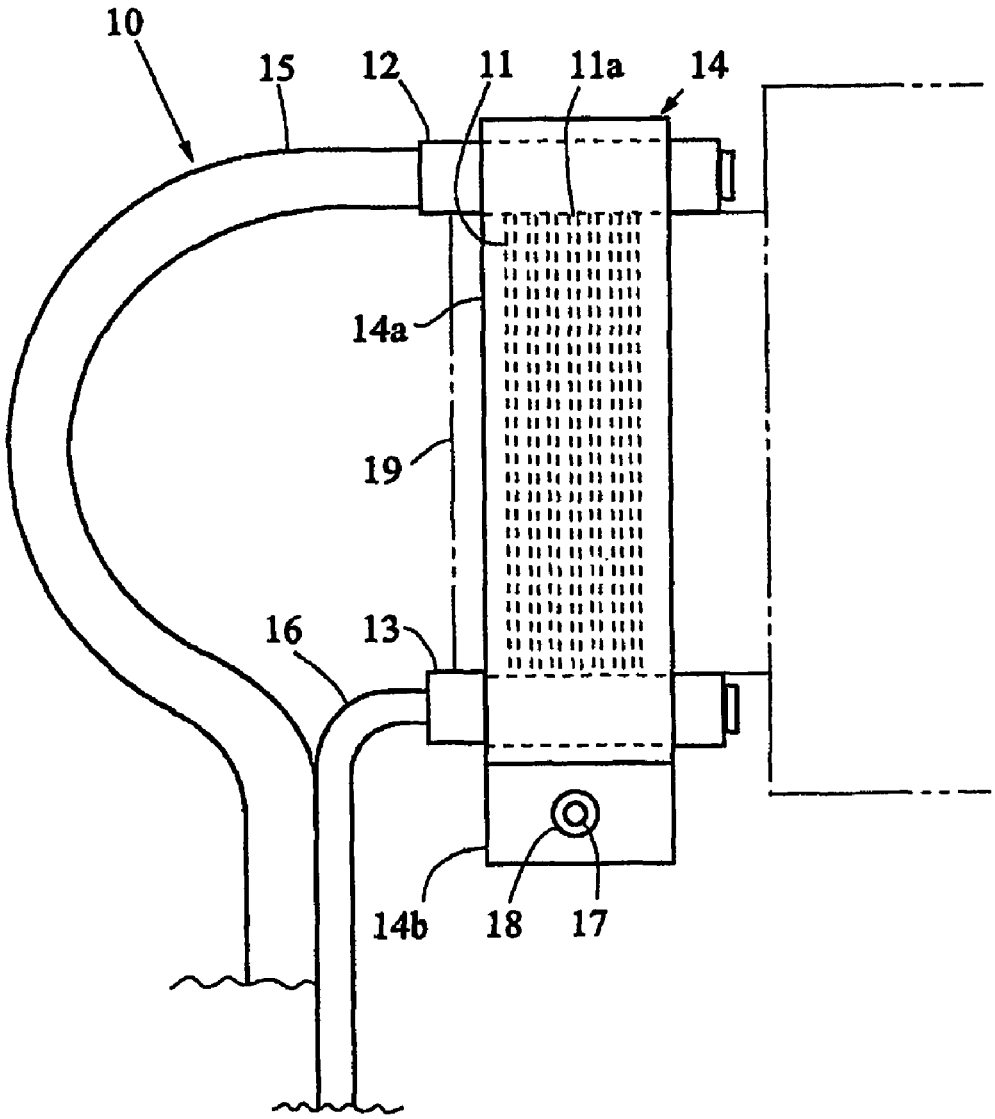
FIG. 1 is a schematic side view of the condenser according to the present invention.
Figure 2:
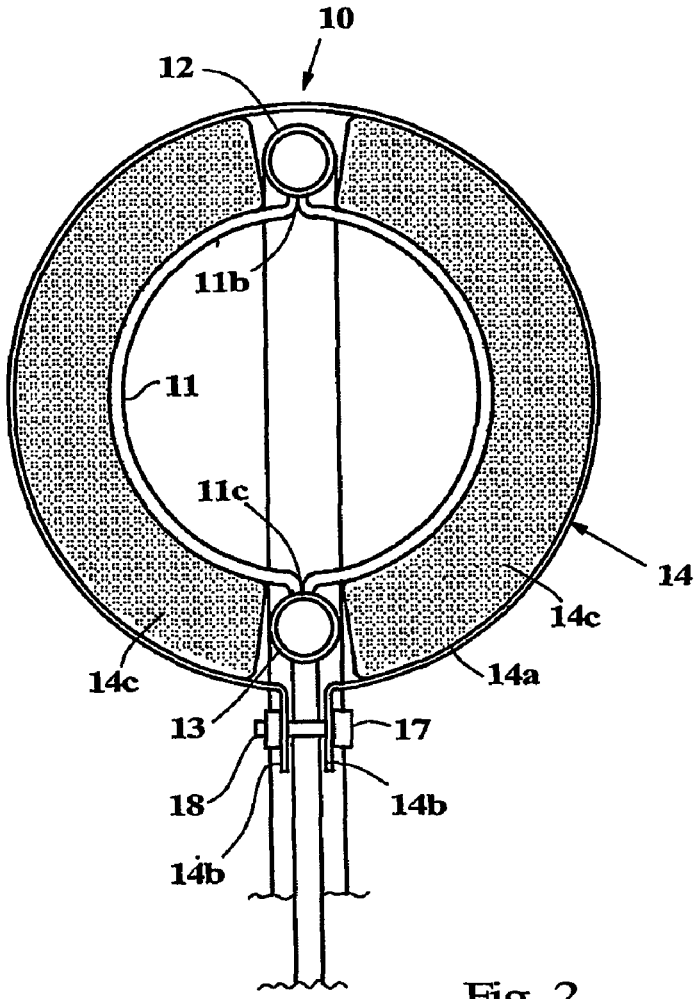
FIG. 2 is a schematic front view of the condenser according to the present invention.

FIGS. 1 and 2 shows a condenser 10, which condenses a vaporized refrigerant by rejecting heat to a cylindrical heat absorption portion 19 that comprises an exterior cooling device. The condenser 10 is comprised of a condensing portion 11, an inlet portion 12, an outlet portion 13, and a clamp 14. As the refrigerant, suitable material of which phase changes from a gas to a liquid state, is chosen, for example like carbon dioxide. Depending on the temperature of the heat absorption portion 19 and the like, appropriate refrigerant and appropriate filling pressures are selected. The condensing portion 11 is comprised of a flat plate of aluminum formed so as to surround the outer periphery of the cylindrical heat absorption portion 19.

Figure 3:
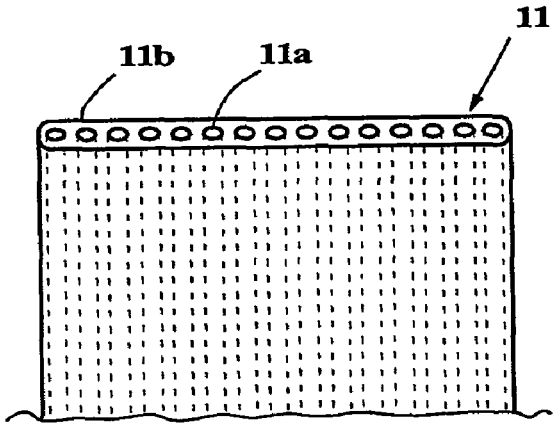
FIG. 3 is a schematic enlarged view of the cooling device according to the present invention.

As shown in FIG. 3, the flat plate of the condensing portion 11 is provided so that a number of through holes 11*a* are disposed in parallel with each other in the direction of the circumference of the condensing portion 11. The flat plate of the condensing portion 11 is divided into two semicircles at two positions of the circumference thereof; end faces 11*b* and 11*c*, which are perpendicular to the circumference of the flat plate of the condensing portion 11. While the inlet portion 12 is connected to the end face 11*b* of the flat plate of the condensing portion 11 so as to communicate with all of the through holes 11*a*, the outlet portion 13 is connected to the end face 11*c* of the flat plate 11 so as to communicate with all of the through holes 11*a*.

Figure 4:
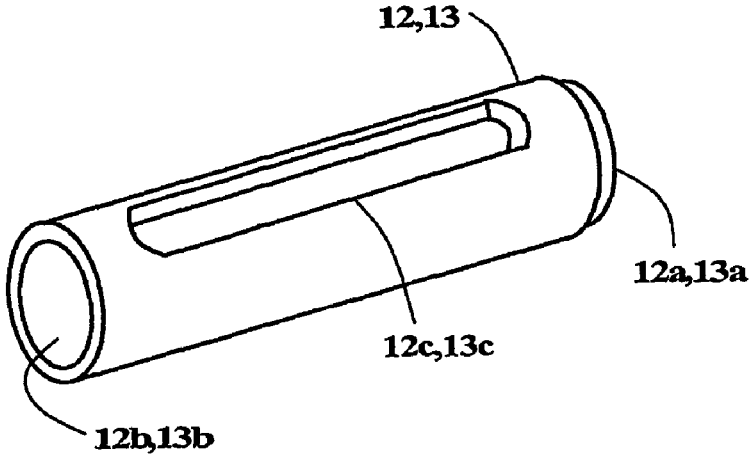
FIG. 4 is a schematic enlarged perspective view of inlet portions and outlet portions of the cooling device according to the present invention.

As shown in FIG. 4, the inlet portion 12 and outlet portion 13 are made from aluminum hollow tubes having closed ends 12*a*, 13*a* and open ends 12*b*, 13*b*, respectively. The slits 12*c*, 13*c* are formed on the circumferential surface of the inlet portion 12 and outlet portion 13, respectively, and connected to the end faces 11*b*, 11*c* of the flat plate of the condensing portion 11 by brazing. While the open end 12*b* of the inlet portion 12 is connected by brazing to an inflow passage 15 of the refrigerant formed an aluminum tubes, the open end 13*b* of the outlet portion 13 is connected by brazing to an outflow passage 16 of the refrigerant. The section area of the outflow passage 16 is smaller than that of the inflow passage 15.

The clamp 14 is comprised of an insulator 14*c* and a band 14*a*. The insulator 14*c* is formed of polycarbonate thermoplastic resin in a semicircle shape so as to surround the outer periphery of the condensing portion 11. The band 14*a* is formed of stainless steel in a cylindrical shape so as to surround the outer surface of the insulator 14*c*. The condensing portion 11 is inserted into the cylindrical heat absorption portion 19 and fixed thereto in such a manner that the band 14*a* is fastened by inserting a bolt 17 into through holes formed in the both end portions 14*b* of the band 14*a* and screwing it by a nut 18.

The insulator 14*c* of synthetics resin is used as it enable to prevent heat of the outside air from being transmitted to the condensing portion 11 and also enables to utilize elasticity of the synthetics resin in applying uniform radial pressures for fastening the band 14*a*.

In other embodiment, the condensing portion 11 may be formed in a circumferential shape and cut at one portion thereon to form two end faces, and then either of those two end faces is connected with either the inlet portion 12 or the outlet portion 13.

Figure 5:
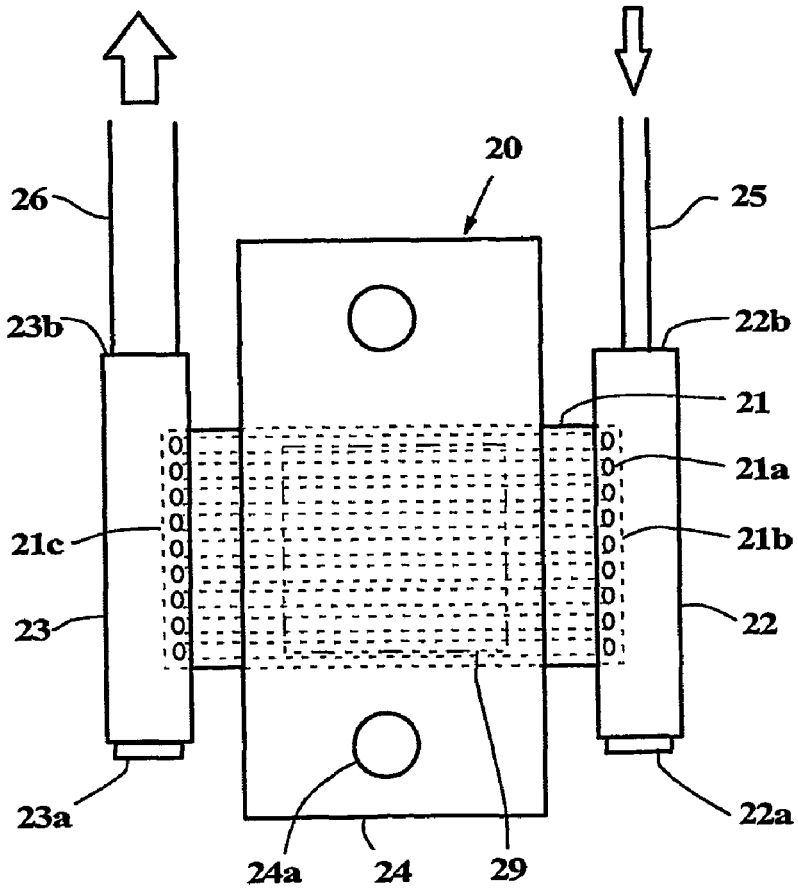
FIG. 5 is a schematic plan view of the evaporator according to the present invention.
Figure 6:
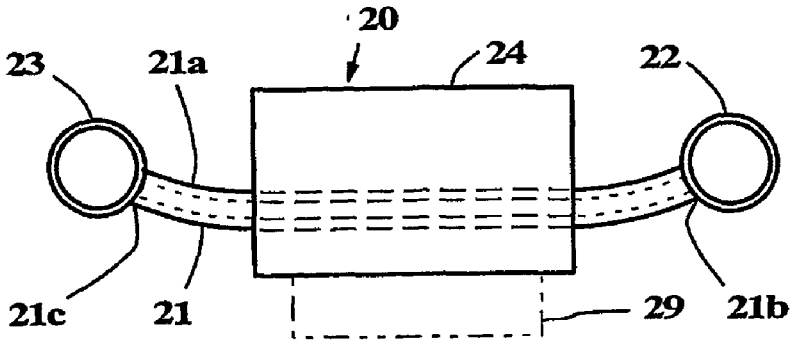
FIG. 6 is a schematic front view of the evaporator according to the present invention.

FIGS. 5 and 6 shows an evaporator 20, which is comprised of a vaporizing portion 21, an inlet portion 22 and an outlet portion 23, and vaporizes the refrigerant by absorbing heat from an exterior heat source 29. The vaporizing portion 21 is comprised of a flat aluminum plate with a number of through holes 21*a* provided in parallel with each other. The inlet portion 22 and the outlet portion 23 are formed of hollow aluminum tubes, and have closed ends 22*a*, 23*a* and open ends 22*b*, 23*b*, respectively. One end portion 21*b* of the vaporizing portion 21 is connected to the outer surface of the inlet portion 22 by brazing so that all of the through holes 21 communicate therewith. The other end portion 21*c* of the vaporizing portion 21 is connected to the outer surface of the outlet portion 23 by brazing so that all of the through holes 21*a* communicate therewith.

The open end 22*b* of the inlet portion 22 is connected to the inflow passage 25 of the refrigerant by brazing, and the open end 23*b* of the outlet portion 23 is connected to the outflow passage 26 of the refrigerant by brazing. The section area of the outflow passage 26 is larger than that of the inflow passage 25. The vaporizing portion 21 is inserted into a head block 24 formed of aluminum, and is screwed on the top face of the exterior heat source 29 at its through holes 24*a*.

The vaporizing portion 21 and the head block 24 may be integrally formed into a single-piece member, directly attached on the top face of the exterior heat source 29 by means of a cover for example, instead of the head block 24.

Figure 7:
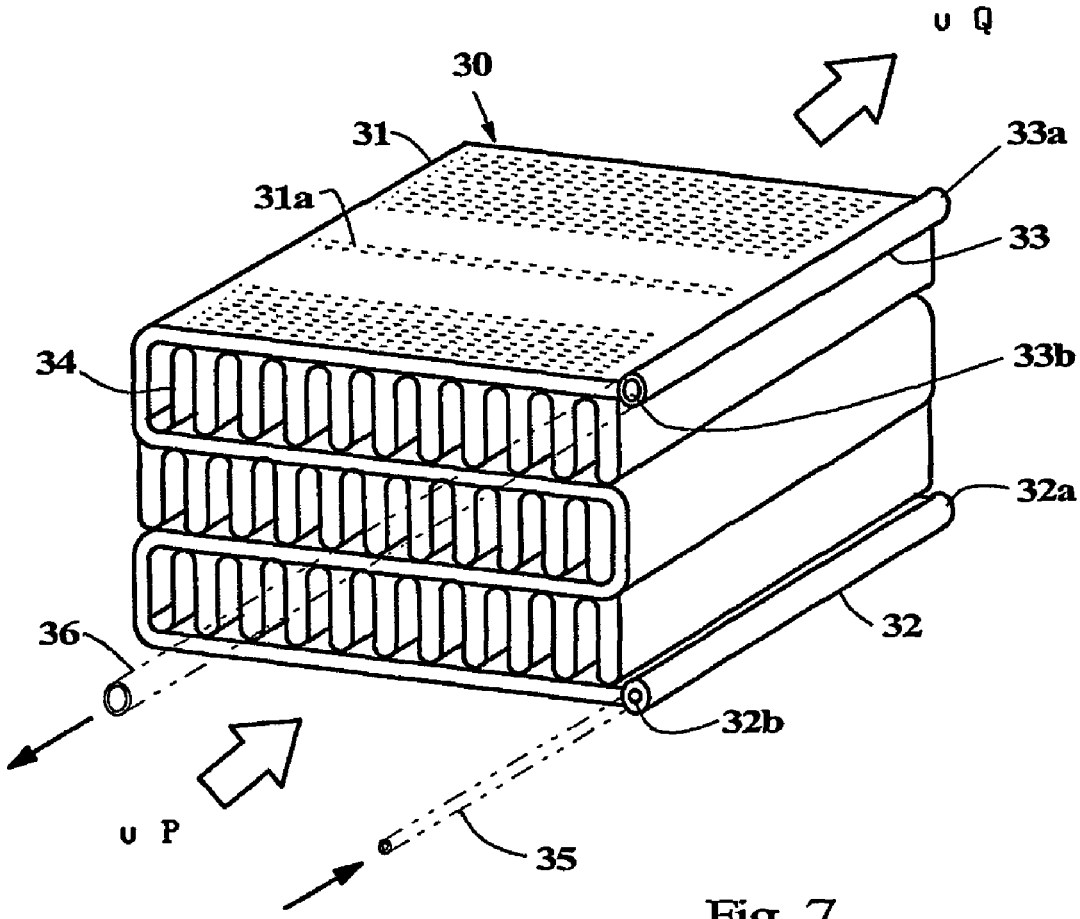
FIG. 7 is a schematic perspective view of the evaporator with the thin fin between the bended vaporization portion.

FIG. 7 shows an evaporator 30 that vaporizes a liquid refrigerant by absorbing heat from air passing through. The evaporator 30 includes a vaporizing portion 31, an inlet portion 32, an outlet portion 33 and fins 34. The vaporizing portion 31 is formed of a aluminum flat plate with a plurality of through holes 31*a* arranged in parallel with each other. And the vaporizing portion 31 is bended at three positions and forms three spaces having rectangular cross section between the flat portions of it. The fins 34 are formed to have wave shapes with thin aluminum plate, and inserted into the spaces contacting with the flat surfaces of the vaporizing portion 31 at top position of the wave shapes.

The inlet portion 32 and the outlet portion 33 are aluminum hollow tubes having a closed end 32*a*, 33*a* and an open end 32*b*, 33*b* respectively.

The inlet portion 32 is connected to one lower end portion of the vaporizing portion 31 at its outer circumferential surface. And the inlet portion 32 communicates with all of the through holes 31*a*.

The outlet portion 33 is connected to the other higher end portion of the vaporizing portion 31 at its outer circumferential surface. And the outlet portion 33 communicates with all of the through holes 31*a*.

Then the open end 32*b* of the inlet portion 32 is connected to an inflow passage 35 of the refrigerant made from aluminum tube. And the open end 33*b* of the outlet portion 33 is connected to an outflow passage 36 of the refrigerant made from aluminum tube of which section area is larger than that of the inflow passage 35.

By employing the above-described configuration, the liquefied refrigerant flows into the lower position of the vaporizing portion 31 through the inflow passage 35, then gradually vaporizes within the through holes 31*a*, and finally flow out from the higher position of the vaporizing portion 31 through the outflow passage 36 with larger section area.

In the above invention, the bending positions of the vaporizing portion 31 are not limited to three positions, but one, tow and more four bending position are available. And the wave shape of the fin 34 is not limited U shape, but V shape and other shapes are available.

Figure 8:
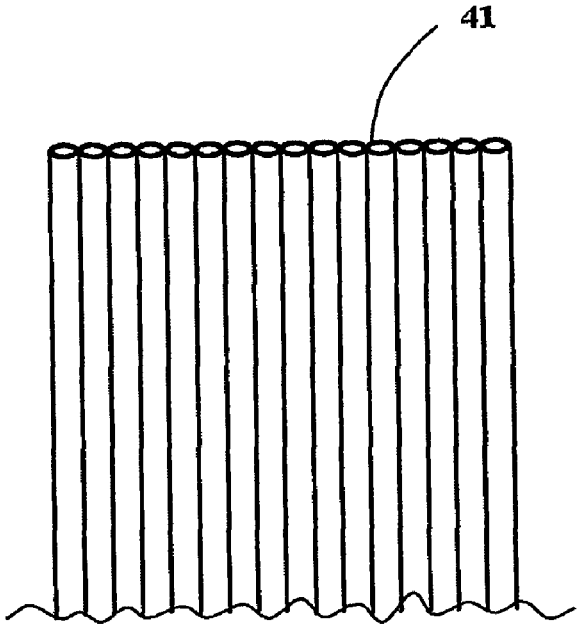
FIG. 8 is a schematic arrangement view of hollow tubes used for the condenser or the evaporator according to the present invention.

FIG. 8 shows a plurality of hollow tubes 41 arranged and fixed in parallel with each other by brazing. Each of the hollow tubes 41 is made of aluminum and has 1 mm in diameter. By employing those hollow tubes 41, either the condensing portion 11 or the vaporizing portion 21, 31 may be manufactured in a simpler manner and at a lower cost.

Figure 10:
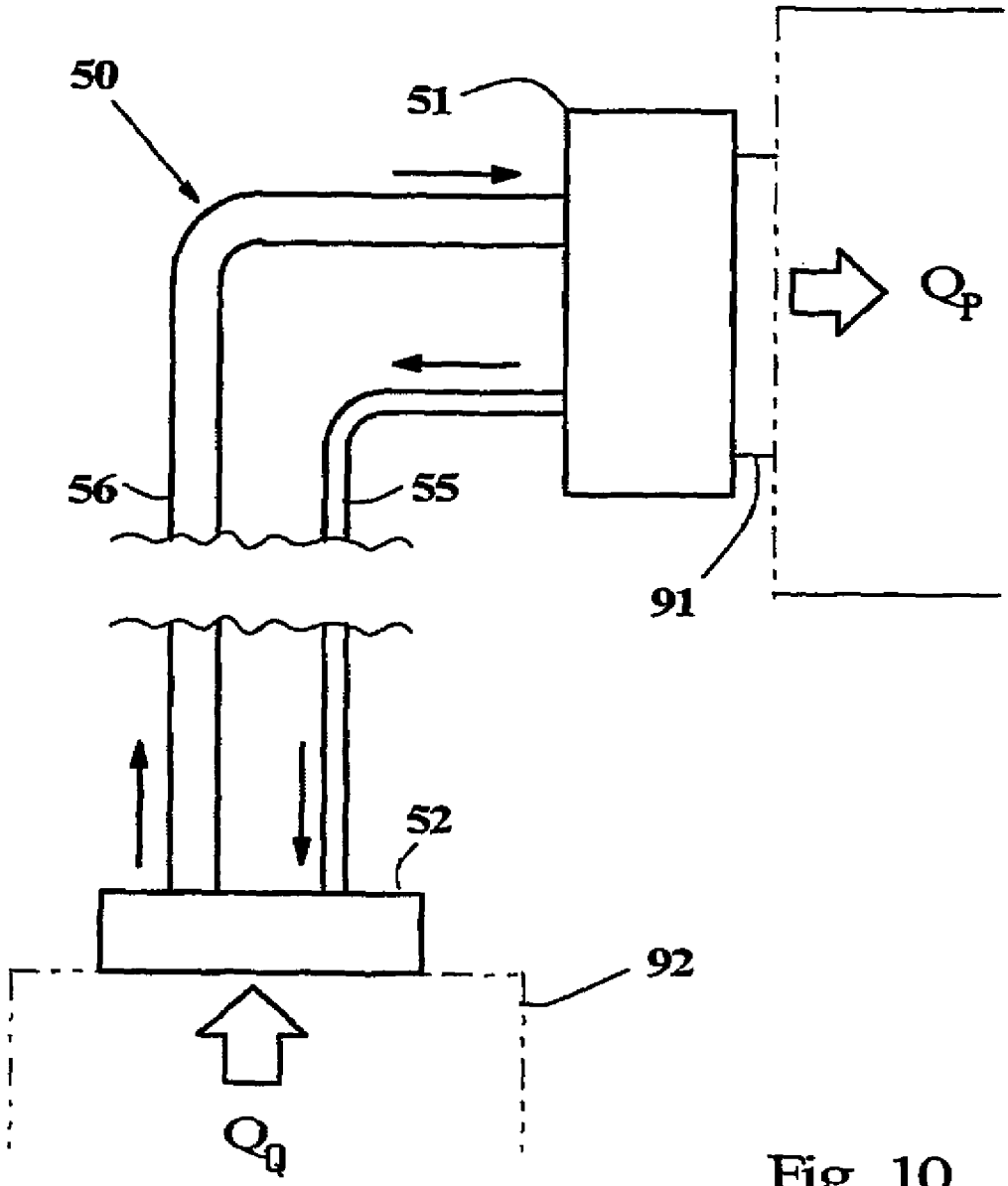
FIG. 10 is a schematic view of a conventional cooling means.

By applying the condenser 10 and evaporator 20 of the present invention to the heat reject portion 51 and heat absorption portion 52 in FIG. 10 respectively, a compact cooling device which has higher cooling efficiency and easy maintenance is achieved.

If the condenser 10 is located in an upper position of the evaporator 20 as shown in FIG. 10, the refrigerant can be continuously circulated without an external power by the gravity difference between the liquid refrigerant and the vaporized refrigerant. However, if the condenser 10 is located at an almost same position as the evaporator 20 or at a lower position than the evaporator 20, the refrigerant cannot be circulated without a driving pump.

Figure 9:
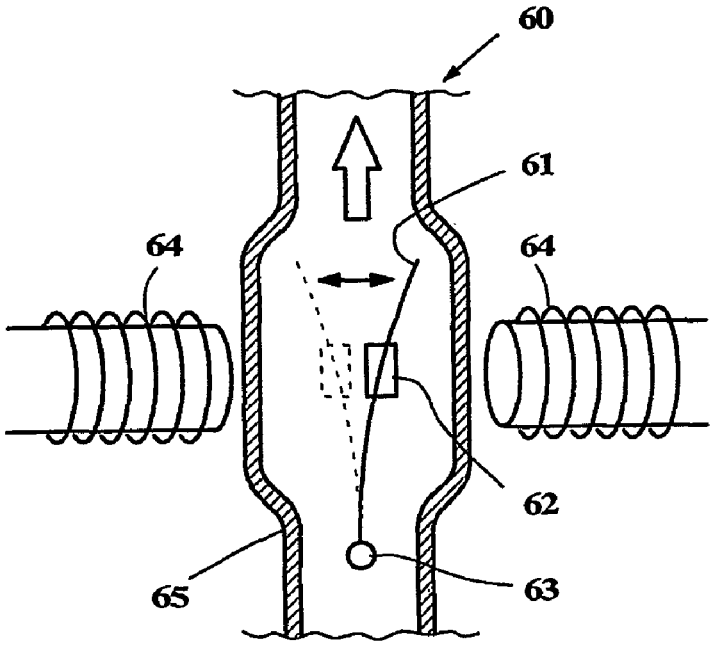
FIG. 9 is a schematic view of a driving pump of refrigerant according to the present invention.

FIG. 9 shows a driving pump 60 so called "fish tail pump," which is known for its compact and simple structure. The driving pump 60 is installed in a refrigerant passage 65, and has a sheet spring 61 supported at the supporting point 63. As a small piece of metal such as iron is attached on the sheet spring 61, it is vibrated by an electromagnet 64. Vibration of the sheet spring 61 sends out the refrigerant in such a way that fish moves its tail fin. A small amount of power is enough to send out the refrigerant if the sheet spring 61 is vibrated at its resonance speed.

The invention claimed is:

1. A condenser for condensing a refrigerant gas by rejecting heat of said gas to a column-shaped heat absorption portion of an exterior cooling device, the condenser comprising:

(a) a condensing portion formed of a flat plate shaped to surround and fixed to the entire periphery of said column-shaped heat absorption portion, said condensing portion having a plurality of parallel through holes formed along the circumferential direction and opening through opposite end faces of the plate;

(b) an inlet portion formed by a first hollow tube having a closed end, an open end connected to a refrigerant inflow passage, and an opening trough the circumferential side wall of the first hollow tube, the first hollow tube being connected at the side wall opening to a first one of the opposite end faces of said condensing portion and communicating with the parallel holes; and (c) an outlet portion formed by a second hollow tube having a closed end, an open end connected to a refrigerant outflow passage, and an opening through the circumferential side wall of the second hollow tube, the second hollow tube being connected at the side wall opening to a second one of the opposite end faces of said condensing portion and communicating with the parallel holes, the cross is sectional area of the outflow passage being smaller than the cross sectional area of the inflow passage.

2. The condenser of claim 1 wherein said condenser is provided wit a clamp formed to surround said condensing portion and attaching the condensing portion to the column-shaped heat absorption portion.

3. The condenser of either claim 1 or 2 wherein said condensing portion is comprised of a plurality of parallel hollow tubes that are brazed together.

4. An evaporator for vaporizing a liquid refrigerant by absorbing heat from an exterior beat source, the evaporator comprising:

(a) a vaporizing portion formed of a flat plate having a plurality of parallel through holes opening through opposite end faces of the plate, the vaporizing portion being attached to the exterior heat source;

(b) an inlet portion formed by a first hollow tube having a closed end, an open end connected to a refrigerant inflow passage, and an opening trough the circumferential side wall of the first hollow tube, the first hollow tube being connected at the side wall opening to a first one of the opposite end faces of said condensing portion and communicating with the parallel holes; and (c) an outlet portion formed by a second hollow tube having a closed end, an open end connected to a refrigerant outflow passage, and an opening trough the circumferential side wall of the second hollow tube, the second hollow tube being connected at the side wall opening to a second one of the opposite end faces of said condensing portion and communicating with the parallel holes, the cross sectional area of the outflow passage being larger than the cross sectional area of the inflow passage.

5. An evaporator for vaporizing a liquid refrigerant by absorbing heat from air passing through, the evaporator comprising:

(a) a vaporizing portion formed of a flat plate having a plurality of parallel through holes opening through opposite end faces of the plate, the plate being bent to form a space between segments of the plate;

(b) fins extending transversely of the through holes and extending in said space and between the segments of the plate;

(b) an inlet portion formed by a first hollow tube having a closed end, an open end connected to a refrigerant inflow passage, and an opening through the circumferential side wall of the first hollow tube, the first hollow tube being connected at the side wall opening to a first one of the opposite end faces of said condensing portion and communicating with the parallel holes; and (c) an outlet portion formed by a second hollow tube having a closed end, an open end connected to a refrigerant outflow passage, and an opening through the circumferential side wall of the second hollow tube, the second hollow tube being connected at the side wall opening to a second one of the opposite end faces of said condensing portion and communicating with the parallel holes, the cross sectional area of the outflow passage being larger than the cross sectional area of the inflow passage.

6. The evaporator of claim 4 or 5 wherein said vaporizing portion is formed of a plurality of parallel hollow tubes that are brazed together.

7. A cooling device comprising:

(a) a condenser for condensing a refrigerant gas by rejecting heat of said gas to a column-shaped heat absorption portion of an exterior cooling device, the condenser comprising:

(i) a condensing portion formed of a flat plate shaped to surround and fixed to the entire periphery of said column-shaped heat absorption portion, said condensing portion having a plurality of parallel through holes formed along the circumferential direction and opening through opposite end faces of the plate;

(ii) a condenser inlet portion formed by a first hollow tube having a closed end, an open end connected to a refrigerant inflow passage, and an opening through the circumferential side wall of the first hollow tube, the first hollow tube being connected at the side wall opening to a first one of the opposite end faces of said condensing portion and communicating with the parallel holes; and (iii) a condenser outlet portion formed by a second hollow tube having a closed end, an open end connected to a refrigerant outflow passage for the condenser, and an opening through the circumferential side wall of the second hollow tube, the second hollow tube being connected at the side wall opening to a second one of the opposite end faces of said condensing portion and communicating with the parallel holes, the cross sectional area of the condenser outflow passage being smaller than the cross sectional area of the condenser inflow passage; and (b) an evaporator for vaporizing the liquid refrigerant by absorbing heat from an exterior heat source, the evaporator comprising:

(i) a vaporizing portion formed of a flat plate having a plurality of parallel through holes opening through opposite end faces of the plate, the vaporizing portion being attached to the exterior heat source;

(ii) an evaporator inlet portion formed by a third hollow tube having a closed end, an open end connected to a refrigerant inflow passage for the evaporator, and an opening through the circumferential side wall of the third hollow tube, the third hollow tube being connected at the side wall opening to a first one of the opposite end faces of said condensing portion and communicating with the parallel holes; and (iii) an outlet portion formed by a fourth hollow tube having a closed end, an open end connected to a refrigerant outflow passage for the evaporator, and an opening through the circumferential side wall of the fourth hollow tube, the fourth hollow tube being connected at the side wall opening to a second one of the opposite end faces of said condensing portion and communicating with the parallel holes, the cross sectional area of the evaporator outflow passage being larger than the cross sectional area of the evaporator inflow passage.

* * * * *

UNITED STATES PATENT AND TRADEMARK OFFICE

CERTIFICATE OF CORRECTION

PATENT NO. : 7,073,567 B2
APPLICATION NO. : 10/474403
DATED : July 11, 2006
INVENTOR(S) : David M. Berchowitz It is certified that error appears in the above-identified patent and that said Letters Patent is hereby corrected as shown below:

Column 7, line 57, “trough” should read --through--.
Column 8, line 2, “cross is sectional” should read --cross sectional--.
Column 8, line 6, “wit” should read --with--.
Column 8, line 13, “beat” should read --heat--.

Signed and Sealed this

Nineteenth Day of September, 2006

JON W. DUDAS
*Director of the United States Patent and Trademark Office*